US007188871B2

(12) United States Patent
Nemoto et al.

(10) Patent No.: US 7,188,871 B2
(45) Date of Patent: Mar. 13, 2007

(54) DOOR LOCK MECHANISM AND DOOR LOCK UNIT

(75) Inventors: Takehiko Nemoto, Hiroshima (JP); Toru Maeda, Hiroshima (JP); Hideharu Kaeriyama, Hiroshima (JP); Hironobu Kondou, Hiroshima (JP)

(73) Assignees: Nifco Inc., Yokohama (JP); Mazda Motor Corporation, Aki-gun, Hiroshima (JP); Nishikawa Kasei Co., Ltd., Hiroshima (JP)

( * ) Notice: Subject to any disclaimer, the term of this patent is extended or adjusted under 35 U.S.C. 154(b) by 78 days.

(21) Appl. No.: 11/029,515

(22) Filed: Jan. 6, 2005

(65) Prior Publication Data

US 2005/0156433 A1 Jul. 21, 2005

(30) Foreign Application Priority Data

Jan. 15, 2004 (JP) ..... 2004-008216

(51) Int. Cl.
*E05C 1/12* (2006.01)
*E05B 65/06* (2006.01)

(52) U.S. Cl. ..... 292/170; 292/121; 292/166; 292/172; 292/DIG. 37; 49/394; 296/37.12

(58) Field of Classification Search ..... 292/39, 292/170, 172, 163, 121, DIG. 37, 139, 166, 292/167; 296/37.12; 49/394
See application file for complete search history.

(56) References Cited

U.S. PATENT DOCUMENTS 359,183 A * 3/1887 Sherwood ..... 292/172
1,257,998 A * 3/1918 Gruber ..... 292/170
1,270,288 A * 6/1918 Gruber ..... 292/170
1,434,370 A * 11/1922 Crompton et al. ..... 292/163
1,688,472 A 10/1928 Shaw
1,764,154 A 6/1930 Cramer
1,828,152 A * 10/1931 Nonamaker ..... 292/170
2,431,105 A * 11/1947 Brinson ..... 292/172
2,763,888 A * 9/1956 Ernst ..... 16/59
3,371,947 A * 3/1968 Gridley ..... 292/144
4,809,867 A * 3/1989 Choi ..... 220/211
5,263,346 A * 11/1993 Sato et al. ..... 70/210

(Continued)

FOREIGN PATENT DOCUMENTS

JP 4038384 * 4/1992

(Continued)

*Primary Examiner*—Brian E. Glessner
*Assistant Examiner*—Carlos Lugo
(74) *Attorney, Agent, or Firm*—Manabu Kanesaka

(57) ABSTRACT

A door lock mechanism includes a lock claw, a spring attached to the lock claw for urging the same in a direction toward a lock state, a lock release operation piece linked to the lock claw for moving the lock claw in a direction toward a lock release state against a force of the spring when a lock release operation is performed, and a damping device for applying a damping force to the lock claw when the lock release operation is canceled. The lock release operation piece returns the lock claw to the lock state with the force when the lock release operation is canceled. The lock release operation piece is arranged to be separated from the lock claw when the lock claw returns from the lock release state to the lock state with an external force applied to the lock claw.

14 Claims, 9 Drawing Sheets

U.S. PATENT DOCUMENTS 5,292,159 A * 3/1994 Sandhu et al. ..... 292/173
5,484,178 A * 1/1996 Sandhu et al. ..... 292/173
5,603,540 A * 2/1997 Shibao ..... 292/341.15
5,626,374 A * 5/1997 Kim ..... 292/170
5,782,510 A * 7/1998 Gass ..... 292/165
5,823,644 A * 10/1998 Suh et al. ..... 312/223.2
6,152,501 A * 11/2000 Magi et al. ..... 292/336.3
6,276,737 B1 * 8/2001 Cansfield et al. ..... 296/37.8
6,712,409 B2 * 3/2004 Monig ..... 292/336.3
6,722,718 B2 * 4/2004 Brown et al. ..... 296/37.12

FOREIGN PATENT DOCUMENTS

JP 10-203250 9/1998

* cited by examiner

DOOR LOCK MECHANISM AND DOOR LOCK UNIT

BACKGROUND OF THE INVENTION AND RELATED ART STATEMENT

The present invention relates to a door lock mechanism for locking a door and a door lock unit including the door lock mechanism.

Various members in an automobile including an instrument panel are provided with a housing mechanism as a compartment and the like. As disclosed in Patent Document 1, such a housing mechanism has a box with an opening and a door attached to the box for opening and closing the opening (generally in an urged state with a spring in an open direction). A lock mechanism is provided on the door for maintaining a closed state of the door when the door closes the opening. The lock mechanism has, for example, a lock claw always urged in a direction toward a locked state, and a lock release operation piece for releasing the lock claw to a lock released state. When the opening is closed by the door, the lock claw engages a coupling part on the box. When the lock release operation piece is released, the lock claw is released from the coupling part on the box against a spring force, thereby opening the door.

Patent Document 1: Japanese Patent Publication (Kokai) No. 10-203250

In the lock mechanism described above, the force always applied on the lock claw to return to the locked state. Accordingly, after a lock release operation on the lock release operation piece, when the hand is removed from the lock release operation piece, in a case that the door opens relatively slower than the lock claw returns to the locked state (the door is disposed inclined toward a closed side in the closed state and a weight of the door acts as a closing force, or the door is pressed deeply toward the closed direction as the lock release operation), there may be a problem that the lock claw returns to the locked state and engages the coupling part on the box, so that the door may not open even trying to open.

In view of the problems described, the present invention has been made, and a first object is to provide, a door lock mechanism capable of assuredly opening a door through a lock release operation without lowering an original locking function.

A second object is to provide a lock unit including the lock mechanism.

Further objects and advantages of the invention will be apparent from the following description of the invention.

SUMMARY OF THE INVENTION

In order to attain the first object, according to the present invention, a door lock mechanism includes a lock claw always urged in a direction toward a locked state with a springing force, and a lock release operation piece linked to the lock claw for moving the lock claw in a direction toward a lock released state against a force of the springing force when a lock release operation is performed. When the lock release operation is canceled, the lock release operation piece returns the lock claw to the locked state with the springing force. The lock claw is set to be independent of the lock release operation piece when the lock claw returns from the lock released state to the locked state with an external force acting directly on the lock claw. A damping is provided for applying a damping force to a returning movement of the lock claw accompanying with release of the lock release operation.

In order to attain the second object, according to the present invention, a door lock unit includes a main body having an attachment part for attaching a door; a lock claw disposed inside the main body to be capable of appearing and disappearing and normally urged in a direction of protruding from the main body with a spring; and a lock release operation piece attached to the main body in a state linked to the lock claw for drawing the lock claw into the main body against a force of the spring when a lock release operation is performed and for allowing the lock claw to protrude from the main body with the force of the spring when the lock release operation is released. The lock claw is set so as to be independent of the lock release operation piece when the lock claw returns from a drawn-in state to a protruding state with an external force acting directly on the lock claw. A damping is provided for applying a damping force to a returning movement of the lock claw accompanying with release of the lock release operation.

In the present invention, the lock claw is set so as to be independent of the lock release operation piece when the lock claw returns from the lock released state to the locked state with an external force acting directly on the lock claw. Accordingly, when a door having the lock mechanism is closed, the lock claw receives the external force from the box and becomes the lock released state. Then, the lock claw immediately returns to the locked state for engaging a coupling part in the box, thereby maintaining the, closed state of the door.

Further, the damping device is provided for applying a damping force to a returning movement of the lock claw accompanying with release of the lock release operation. Accordingly, a time for returning the lock claw accompanying, with the release of the lock release operation becomes relatively longer than a time for returning from the lock released state to the locked state with the external force acting directly on the lock claw. The lock claw is not locked again even when a hand (finger) is removed from the lock release operation piece after the lock release operation, thereby securely opening the door. Accordingly, with the lock mechanism, it is possible to assuredly open the door through the lock release operation without lowering locking function.

According to the present invention, a transmission member may be arranged relative to the lock claw for transmitting a lock release operation force on the lock release operation piece only in a direction toward the lock released state of the lock claw through an engagement with the lock claw. Accordingly, it is possible to make the lock claw independent of the lock release operation piece when the lock claw returns from the lock released state to the locked state with the external force acting directly on the lock claw. When a door with the lock mechanism is closed, the lock claw engages the coupling part in the box, thereby maintaining the closed state of the door.

Further, the damping device for applying a damping force is provided in the transmission member or the lock release operation piece moving accompanying with the lock release operation force and the release of the operation force. Accordingly, the time for returning the lock claw accompanying with the release of the lock release operation force becomes relatively longer than the time for returning from the lock released state to the locked state with the external force acting directly on the lock claw. Accordingly, it is possible to prevent the lock claw from being locked again even if the hand is removed from the lock release operation piece after the lock release operation. Therefore, with the lock mechanism, it is possible to assuredly open the door through the lock release operation without lowering locking function.

According to the present invention, the lock release operation piece may be formed of a push button to be pushed as the lock release operation. A push direction switching mechanism is interposed between the push button and the transmission member for switching a pressing force on the push button in the direction toward the lock released state of the lock claw and transmitting the pressing force to the transmission member. Accordingly, it is possible to perform operations such as locking with the lock claw and releasing the lock with the push button. It is also possible to apply a damping force to a member moving accompanying with the returning movement of the lock claw after an operation of the push button. Accordingly, even if the lock release operation piece is of a type to be pushed as the lock release operation, it is possible to obtain the same operating effect as described above.

According to the present invention, the lock release operation piece may be formed of an operation lever to be displaced in the direction toward the lock released state of the lock claw as the, lock release operation. The transmission member is integrated with the operation lever. Accordingly, it is possible to perform operations such as locking with the lock claw and releasing the lock through an operation of the operation lever. It is also possible to apply a damping force to a member moving accompanying with the returning movement of the lock claw after an operation of the operation lever. Accordingly, even if the lock release operation piece is of a operation lever type, it is possible to obtain the same operating effect as described above.

According to the present invention, a rack and a rotation type damper rotating for generating a damping force while engaging with the rack may be used as the damping device. Accordingly, it is possible to obtain the same operating effect as described above and make the door lock mechanism compact through the rack and the rotation type damper.

According to the present invention, when the door lock mechanism is used for an opening-and-closing door of a compartment structure in an automobile, it is possible to accurately operate the door lock mechanism.

According to the present invention, even when the opening-and-closing door is disposed in an inclined state and may be locked again after the lock release operation, it is possible to assuredly open the opening-and-closing door while preventing locking again with the door lock mechanism.

According to the present invention, the door lock unit is attached to a door through the attachment part. Accordingly, it is possible to assure independence of the lock claw, and apply a damping force on the returning operation of the lock claw accompanying with the release of the lock release operation. The components are disposed inside and at periphery of the main body. Accordingly, it is possible to make the unit compact and easily handle the door lock unit.

According to the present invention, it is possible to incorporate the lock mechanism including the components of the damping device in the door lock unit, thereby making it easy to handle and attach the door lock unit.

DETAILED DESCRIPTION OF PREFERRED EMBODIMENTS

Figure 1:
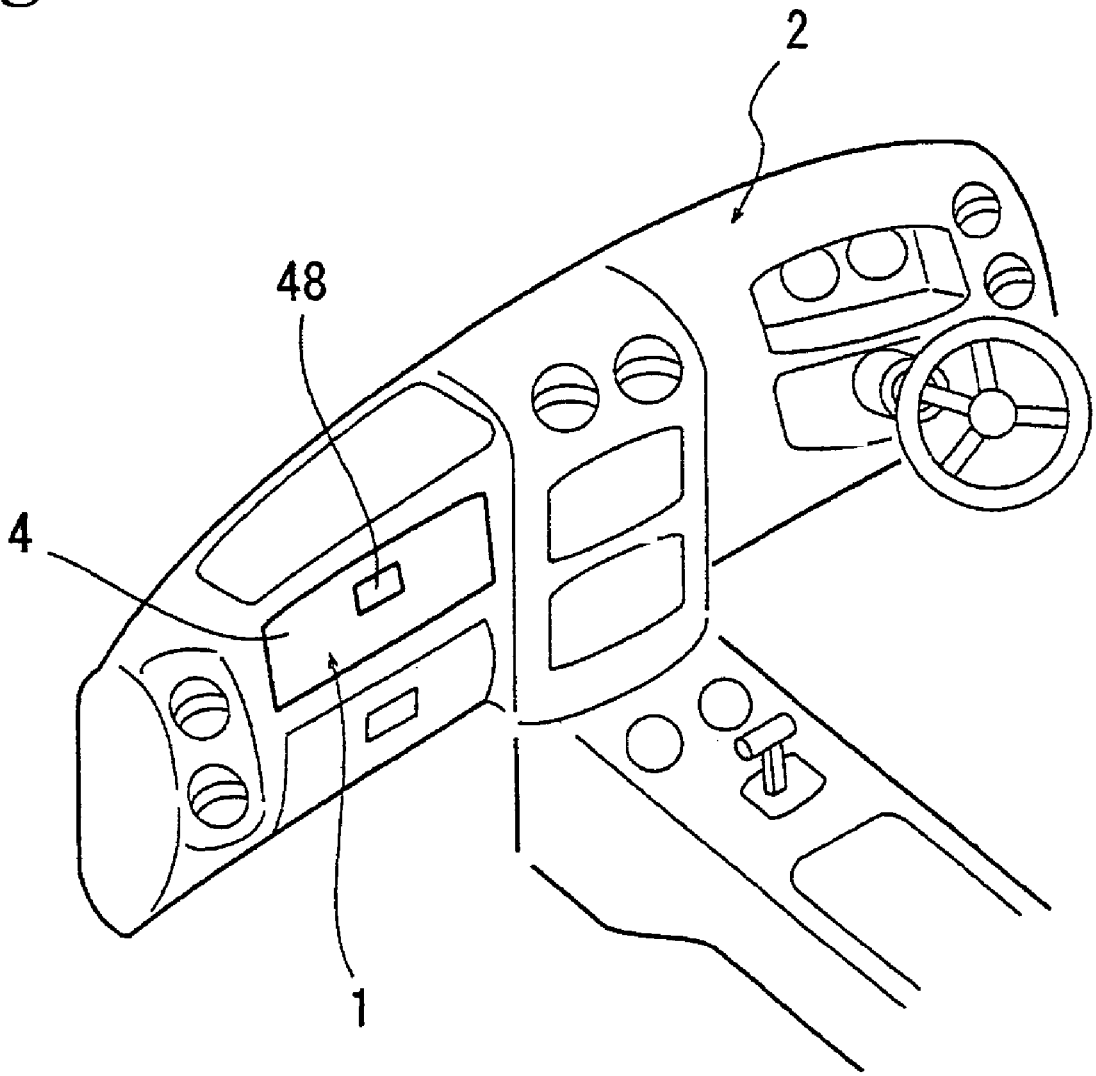
FIG. 1 is a perspective view showing a glove box provided with a lock mechanism (lock unit) according to a first embodiment of the present invention.
Figure 2:
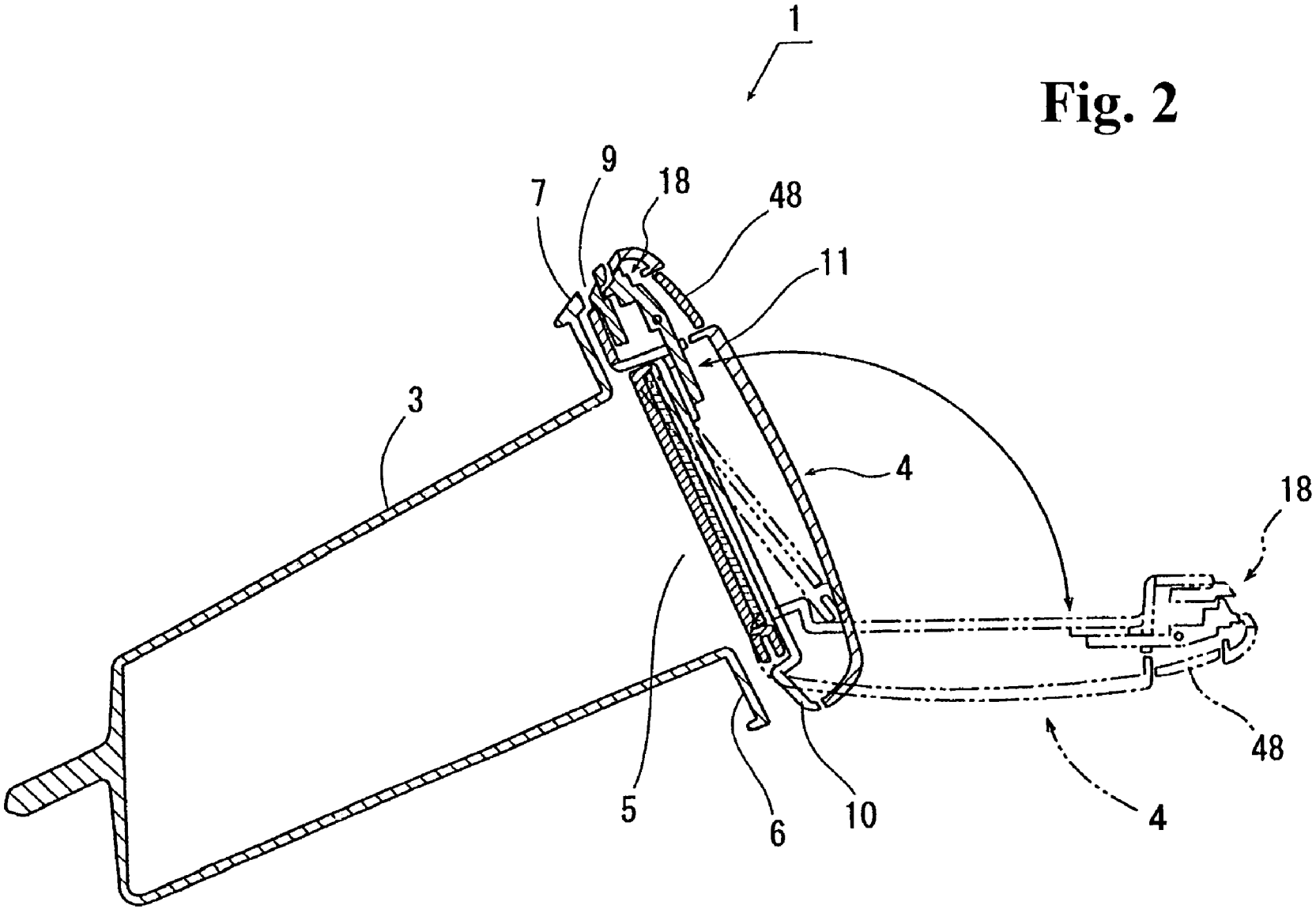
FIG. 2 is a vertical sectional view showing the glove box according to the first embodiment.
Figure 3:
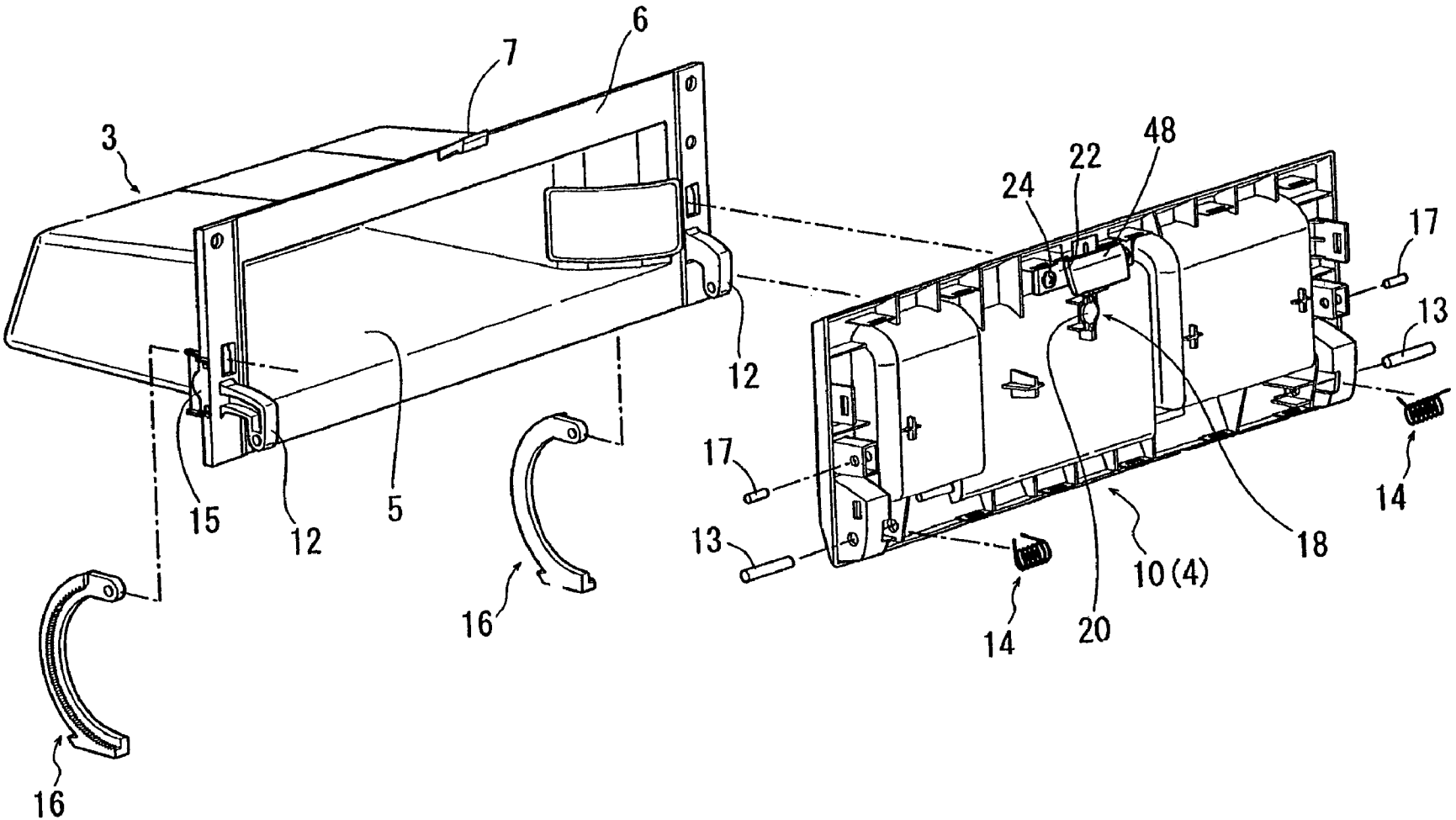
FIG. 3 is an exploded view showing the glove box according to the first embodiment.

Hereunder, embodiments of the present invention will be explained with reference to the accompanying drawings. In FIG. 1, reference numeral 1 denotes a glove box as a storage compartment attached to an instrument panel 2 of an automobile. As shown in FIGS. 2 and 3, the glove box 1 comprises a box 3 forming a storage space and a lid 4 as a door.

The box 3 is disposed inside the instrument panel 2. The box 3 has a front part opening 5 at a front part (right side part in FIG. 2), and the front part opening 5 opens in a vehicle compartment (outside) from the instrument panel 2. A flange part 6 is provided on a periphery of the front part opening 5. The flange part 6 is inclined so as to follow a front surface of the instrument panel 2. In an upper center part of that flange part 6, a projecting part 7 is extended from the flange part 6. The projecting part 7 protrudes diagonally forward upwardly. A lower surface of the projecting part 7 from a front end part to the flange part 6 becomes a guide surface 8 (see FIG. 5) for a lock claw (described later), and a coupling hole 9 is formed at a middle of the projecting part 7.

As shown in FIG. 2 and FIG. 3, the lid 4 is formed of an inner panel 10 and an outer panel. A base end part of the lid 4 is rotatably supported on support parts 12 on both sides of a lower part of the box 3 with pins 13. When the front end part of the lid 4 rotates and moves toward the upper part of the flange part 6, the lid 4 covers the front part opening 5 of the box 3. Springs 14 are disposed between the lid 4 and the box 3 in a state that the springs 14 are fitted in the pins 13. The springs 14 urge the lid 4 in a direction of opening the front part opening 5 of the box 3. Rotation type dampers 15 are attached on both side surfaces at a front side of the box 3 for generating a damping force through rotation. Arc-shaped racks 16 are supported on the side parts of the lid 4 (inner panel 10) with pins 17 for transmitting the damping force of the rotation type dampers 15. The rotation type dampers 15 have rotating parts capable of engaging the racks 16, and the rotating parts rotate by a displacement movement of the rack 16 (lid 4) engaging the rotating part, thereby generating the damping force. The rotation type dampers 15 are disclosed in detail, for example, in Japanese Patent No. 2884267, and are already known. When the lid 4 opens, the lid 4 does not open at once with the force of the spring 14, rather opens gently by the damping force of the rotation type damper 15.

As shown in FIG. 2 and FIG. 3, a lock mechanism 18 is provided on the lid at an upper center part thereof. In the present embodiment, the lock mechanism 18 is formed of a lock unit 19 assembled of plastic parts and a rotation type damper 20 constituting a part of the damping device.

Figure 4:
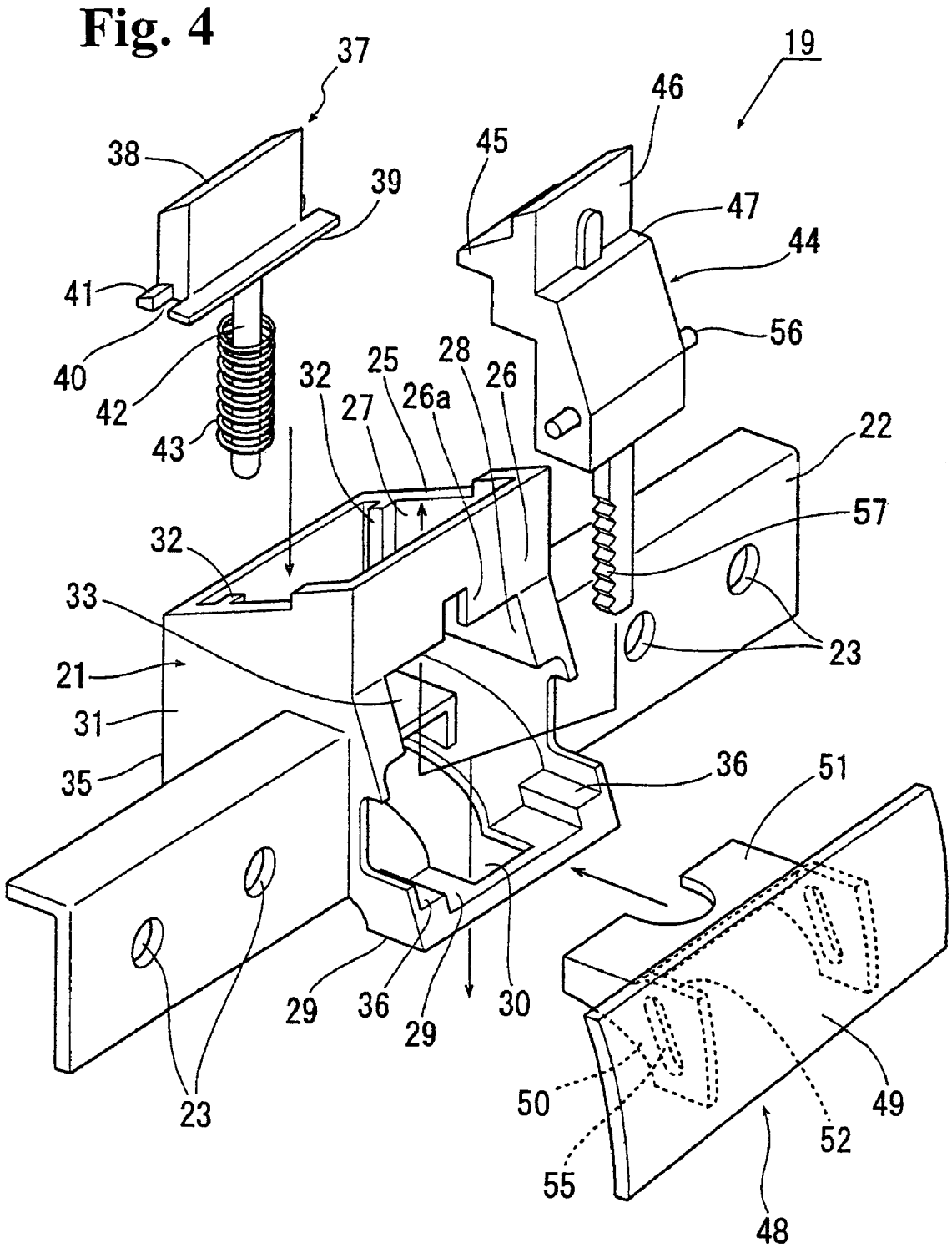
FIG. 4 is an exploded view showing the lock unit according to the first embodiment.
Figure 5:
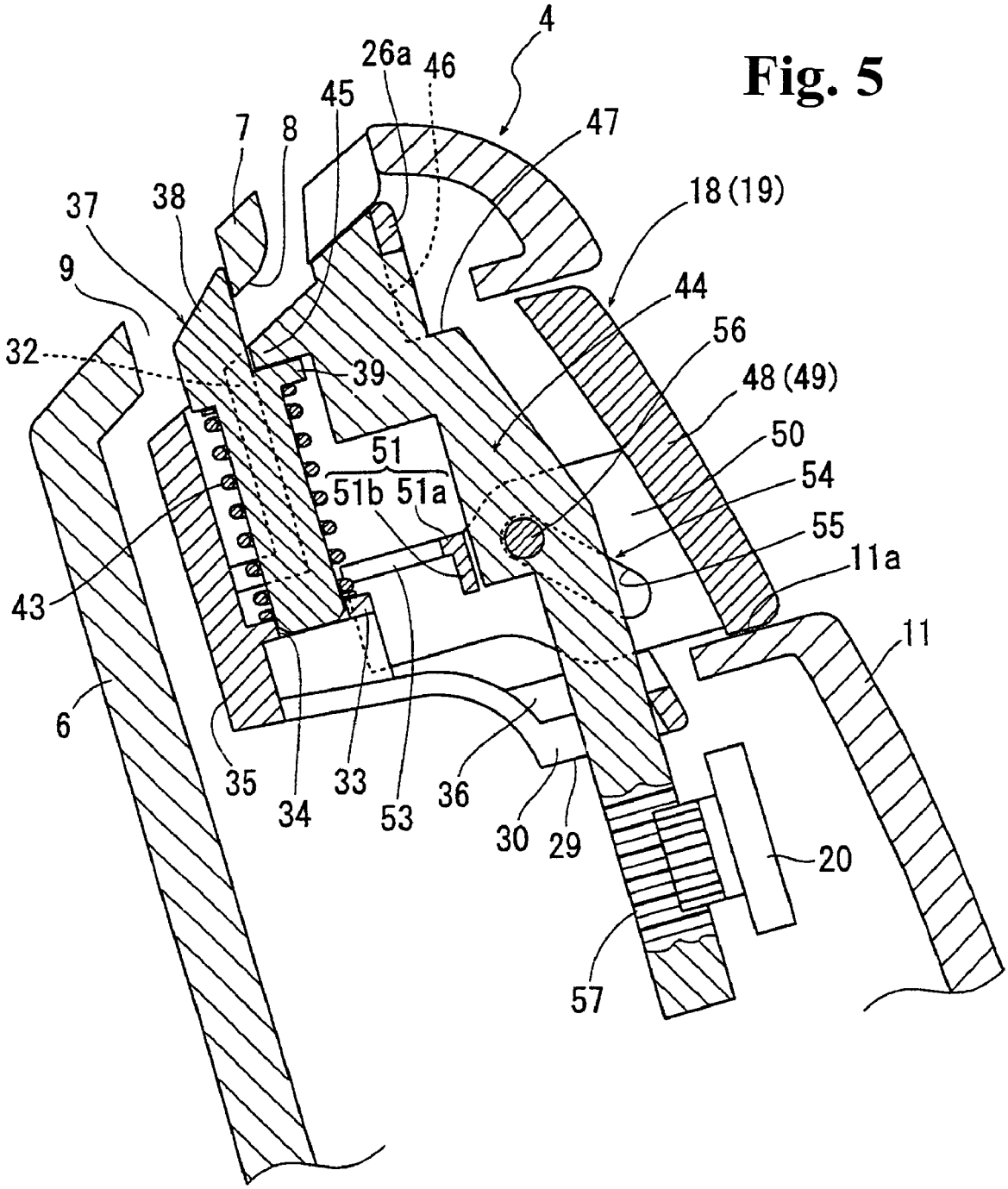
FIG. 5 is an explanatory sectional view for explaining a structure of the lock mechanism (lock unit) according to the first embodiment.

As shown in FIG. 4 and FIG. 5, the lock unit 19 has a box-shaped main body part 21 as a main body. On the main body part 21, attachment parts 22 are provided on both side surfaces of the front part, and extend away from each other. An attachment hole 23 is formed on each of the attachment parts 22. When the attachment part 22 is attached to the upper center part of the outer surface of the inner panel 10 with the attachment hole 23 and a fastening tool 24 (see FIG. 3), a major part of the main body part 21 passes through the inner panel 10 and protrudes on the inner surface side (front part opening 5 side) of the inner panel 10.

As shown in FIG. 4 and FIG. 5, the main body part 21 is formed of an upper wall part 25, front wall part 26, bottom wall part 29, a pair of sidewall parts 31, and a rear wall part 35. The main body part has an almost entirely hollow inner portion. Openings 27 and 28 are formed almost entirely in the upper wall part 25 and the front wall part 26, respectively. Further, a band-like slit 30 is formed on the bottom wall part 29 so as to extend from the rear wall part 35 side to the front wall part 26 side. Accordingly, the inner part of the main body part 21 opens outside.

More concretely, the upper wall part 25 has an upper surface inclined downwardly toward the rear wall part 35, and corresponding to the guide surface 8 of the projecting part 7. When the lid 4 is closed, the main body part 21 does not interfere with the projecting part 7. The bottom wall part 29 has a step part such that the front wall part 26 side becomes lower than the rear wall part 35 side. Inner and outer surfaces of the step part are curved and extend between the front wall part 26 side and the rear wall part 35 side. A spring, bearing part 33 is provided on an inner surface of the bottom wall part 29 so as to straddle the slit 30 on the rear wall part 35 side. A pass-through hole 34 is formed in the spring bearing part 33, and the pass-through hole 34 faces the slit 30 (see FIG. 5). On the inner surface of the bottom wall part 29, step parts 36 are formed on the front wall part 26 side. The step parts 36 extend along the inner surfaces of the sidewall parts 31 from the front wail part 26 side toward the rear wall part 35 side, respectively, so that the step parts 36 constitute guide channels of a push button (lock release operation peace; described later). The sidewall parts 31 have guides 32 on the inner surfaces thereof at positions adjacent to the rear wall part 35. Each of the guides 32 extends from the upper wall part opening 27 to a position a little above the spring bearing part 33 in a state of protruding inwardly in the horizontal direction of the main body part 21, and the guides 32 are located at opposing positions.

As shown in FIG. 4 and FIG. 5, a lock claw 37 is housed in the main body part 21. The lock claw 37 comprises a claw part 38; a coupling part 39 projecting from a front surface of a lower part of that claw part 38; a protruding part 41 forming a holding groove 40 on both sides of the claw part 38 in the horizontal direction in coordination with the coupling part 39; and a guide shaft part 42 extending downwardly from a lower surface of the claw part 38. When the lock claw 37 is disposed inside the main body part 21, the coupling part 39 faces the front wall part 26 side of the main body part 21. The guides 32 are fitted into the holding grooves 40, and the guide shaft part 42 passes through the pass-through hole 34 in the spring bearing part 33. As shown in FIG. 4 and FIG. 5, a coil spring 43 is interposed between the claw part 38 of the lock claw 37 and the spring bearing part 33. The coil spring 43 normally urges the claw part 38 in a direction of protruding from inside the main body part 21. In a state when an external force is not acting on the claw part 38, the claw part 38 protrudes from inside the main body part 21 at a locked state position (see FIG. 5).

As shown in FIG. 4 and FIG. 5, a transmission member 44 is housed in the main body part 21 on the front wall part 26 side of the main body part 21 from the lock claw 37. A lower part of the transmission member 44 extends outwardly from the slit 30 of the main body part 21, and an upper part thereof is positioned between the guides 32 and a front wall part opening upper part **26*a* of the main body part 21**.

On the upper part of the transmission member 44, a coupling part 45, a sliding surface 46 (see FIG. 4), and a stopper surface 47 are formed. The coupling part 45 protrudes toward the lock claw 37, and a front end surface of the coupling part 45 abuts against the guides 32 to be slidable. A lower surface of the coupling part 45 abuts against the coupling part 39 of the lock claw 37 with the force of the coil spring 43. When an external force acts directly on the lock claw 37 (claw part 38), the lock claw 37 moves independently toward inside the main body part 21 against the force of the coil spring 43. On the other hand, when such an external force does not act directly on the lock claw 37, the claw part 38 protrudes from the upper wall part 25 (locked state). Further, the force of the coil spring 43 is transmitted to the transmission member 44 through a positional relationship between the coupling part 39 of the lock claw 37 and the coupling part of the transmission member 44, so that the transmission member 44 is urged upwardly.

The sliding surface 46 and the stopper surface 47 are formed of a step at an upper part of the transmission member 44 on the front wall part 26 side of the main body part 21. The sliding surface 46 abuts against an inner surface of the front wall part opening upper part 26a on the main body part 21 to be slidable. The stopper surface 47 is disposed such that an upper edge part of the front wall part opening 28 of the main body part 21 is positioned in a moving area. Accordingly, the transmission member 44 (upper part) is guided by the guides 32 and the inner surface of the front wall part opening upper part **26*a* of the main body part 21 to be movable. When an external force is not acting on the lock claw 37, the stopper surface 47 is displaced until it abuts against the upper edge part of the front wall part opening 28, thereby restricting the lock claw 37 to protrude from inside the main body part 21 within a predetermined amount (see FIG. 5**).

As shown in FIGS. 1 to 5, a push button 48 is disposed on the front side of the front wall part 26 in the main body part 21 as a lock release operation piece. The push button 48 has a press plate part 49; a pair of side plate parts 50 extending in a direction away from an inner surface of that press plate part 49, and a linkage plate part 51 linking the side plate parts 50. A passenger applies a pressing force on the press plate part 49 as a release operation to open the lid 4. The press plate part 49 is disposed inside an open part **11*a* of the outer panel 11 of the lid 4 to be operated from outside. The pair of side plate parts 50 is inserted between the pair of step parts 36 on the inner surface of the bottom wall part 29 of the main body part 21. When the press plate part 49 is pressed, the pair of side plate parts 50 is guided on the two step parts 36 and advances into the main body part 21. In this case, the spring bearing part 33 and transmission member 44 enter between the pair of side plate parts 50, thereby preventing interference with the respective side plate parts 50**.

The linkage plate part 51 links the pair of side plate parts 50 on the rear wall part 35 side of the main body part 21 from the transmission member 44. A pass-through hole 52 is disposed between the press plate part 49 and the linkage plate part 51 for allowing the transmission member 44 to pass through downwardly. The linkage plate part 51 has an upper part linkage plate part 51*a* for linking upper end surfaces of the pair of side plate parts 50, and a side part linkage plate part 51*b* suspended from the upper part linkage plate part 51 on a side of the pass-through hole 52 for linking side surfaces of the pair of side plate parts 50. The upper part linkage plate part 51*a* is positioned above the spring bearing part 33 in order to avoid interference therewith. A semicircular cutout 53 is formed in a center of the front end part of that upper part linkage plate art 51 in order to avoid interference with the guide shaft part 42 and the coil spring 43 of the lock claw 37. The side part linkage plate part 51*b* is suspended so that the front end part of the spring bearing part 33 faces in a movement area thereof. When the side part linkage plate part 51*b* contacts the front end part of the spring bearing part 33, the push button 48 is restricted to enter the main body part 21 beyond a predetermined amount.

Figure 7:
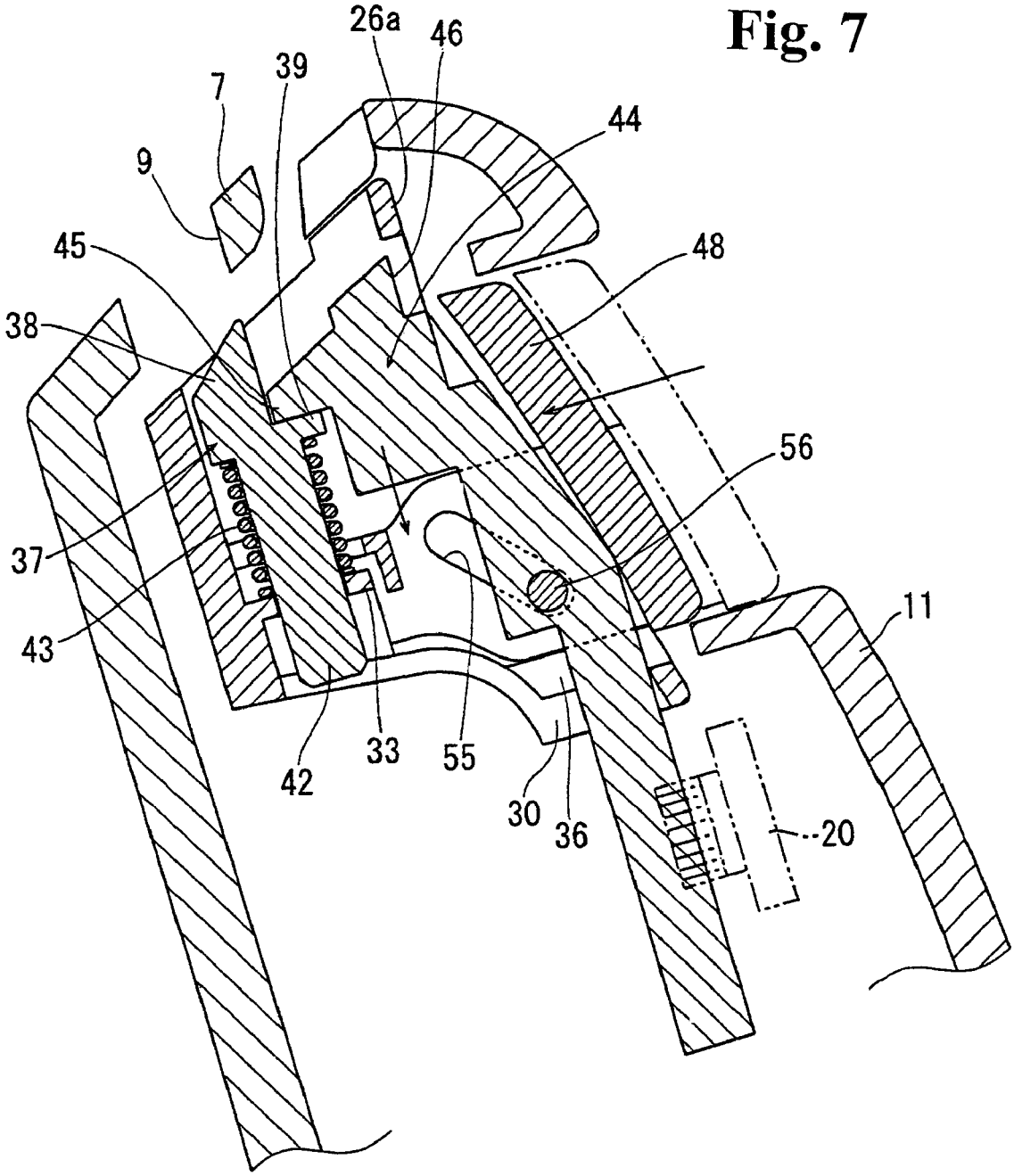
FIG. 7 is an explanatory sectional view for explaining an operation of the lock mechanism when opening the lid.

As shown in FIG. 4 and FIG. 5, a push direction switching mechanism 54 is disposed between the side plate parts 50 and the transmission member 44. In the present embodiment, the push direction switching mechanism 54 includes long holes 55 and pins 56. The long holes 55 are formed symmetrically on each side plate part 50 toward a side of the pass-through hole 52 from the linkage plate part 51, and each of the long holes 55 is inclined upwardly gradually away from the press plate part 49. The pins 56 pass through the long holes 55 and the transmission member 44. The pins 56 are guided inside the long holes 55 to be movable. In the locked state in which the lock claw 37 protrudes from inside the main body part 21, the pins 56 are positioned at upper end parts of the long, holes 55 (see FIG. 5). Therefore, with the push direction switching mechanism 54, as shown in FIG. 7, when the push button 48 is pushed and the push button 48 is moved inside the main body part 21, the guides 32 and the inner surface of the front wall part opening upper part 26*a* of the main body part 21 restrict the upper part of the transmission member 44 to move in the pushing direction of the push button 48. Accordingly, the pins 56 move along the long holes 55 toward lower end parts, and the inclined inner surfaces of the long holes 55 apply a pressing force to the transmission member 44 downwardly through the pins 56. As a result, the transmission member 44 move downwardly while being guided by the guides 32 and the inner surface of the front wall opening upper part 26*a* of the main body part 21.

On the other hand, when the pressing force applied on the push button 48 is released, the force of the coil spring 43 is transmitted to the transmission member 44 through the coupling part 39 of the lock claw 37 and the coupling part 45 of the transmission member 44, thereby lifting the transmission member 44. Accordingly, in the push direction switching mechanism 54, the pins 56 move toward the upper end parts of the long holes 55, and the push button 48 returns to the original position shown in FIG. 5.

As shown in FIG. 4 and FIG. 5, a rack part 57 constituting a part of the damping device is provided on the lower part of the transmission member 44. The rack part 57 is formed in the lower part of the transmission member 44 extending outwardly through the slit 30 of the main body part 21.

As shown in FIG. 5, the rotation type damper 20 has a structure same as that of the rotation type damper 15. As shown in FIG. 3, the rotation type damper 20 is integrated with a pair of flange-shaped attachment pieces. The attachment pieces are attached to attachment bosses protruding from an upper surface of the inner panel 10 of the lid 4 with fastening members such as screws. The rack part 57 engages a rotating part of the rotation type damper 20. The rotation type damper 20 and the rack part 57 constitute the damping device. When the rack part 57 (transmission member 44) moves, the rotating part of the rotation type damper 20 rotates to generate a damping force.

In the glove box 1, the lock mechanism operates in the following manner.

Figure 6:
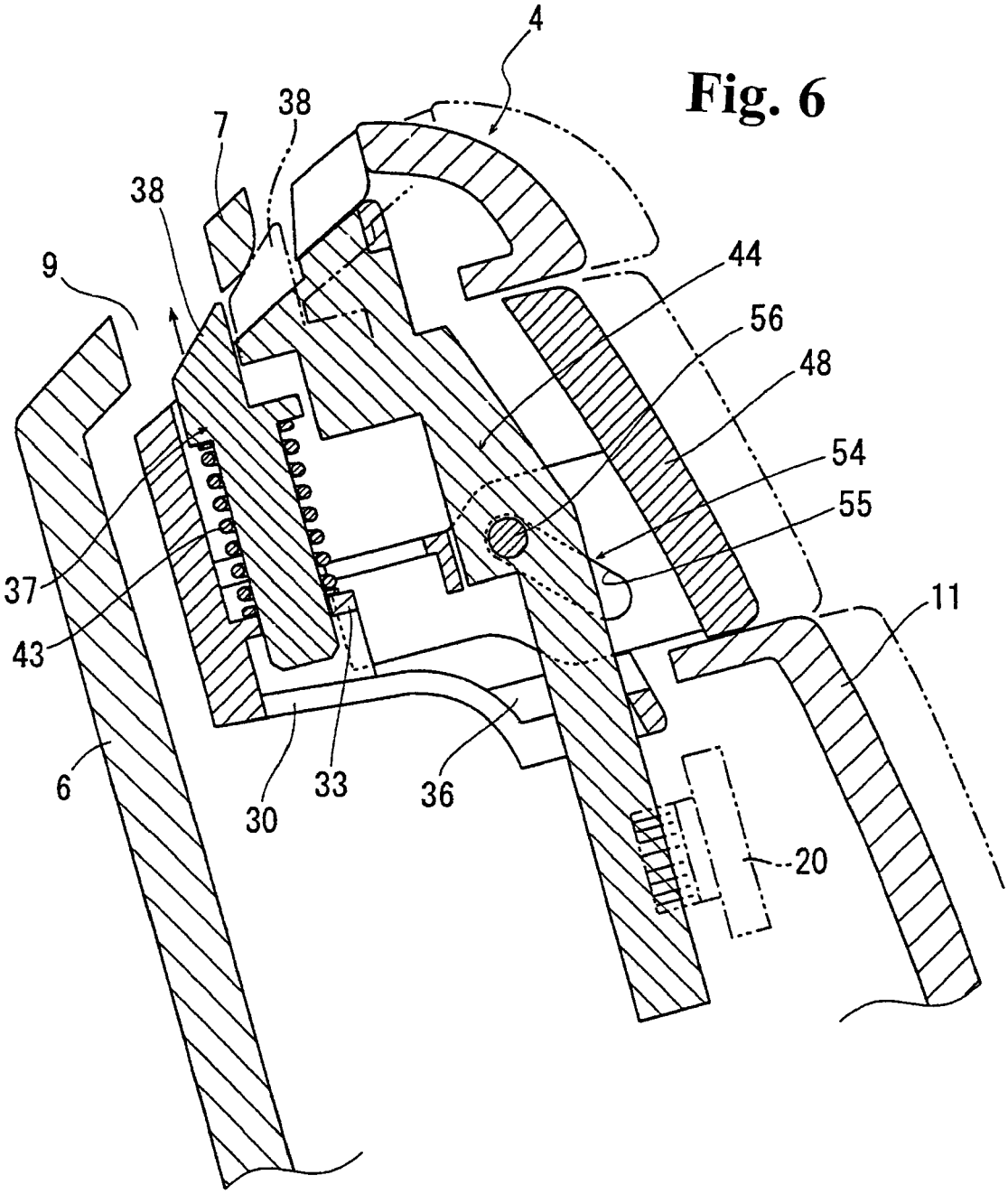
FIG. 6 is an explanatory sectional view for explaining an operation of the lock mechanism when closing a lid.

In the open state of the lid 4, the claw part 38 of the lock claw 37 protrudes from the upper surface of the main body part 21 (upper wall part 25) with the force of the coil spring 43. In this state, when the lid 4 rotates to be closed, the inclined claw part 38 on the lock claw 37 contacts the front end part of the projecting part 7. When the lid 4 rotates further, the claw part 38 receives the external force from the projecting part 7. With the external force, the claw part 38 is drawn into the main body part 21 against the force of the coil spring 43 (see hidden lines in FIG. 6). When the claw part 38 reaches the coupling hole 9, the claw part 38 becomes fee to protrude into the coupling hole 9 with the force of the coil spring 43. Accordingly, the claw part 38 engages the inner perimeter edge of the coupling part 9, thereby maintaining the closed state of the lid 4.

In the closed state of the lid 4, when the push button 48, i.e., the lock release operation piece, is pushed, the push button 48 moves inside the lid 4 and the transmission member 44 moves downwardly with the inclined long holes 55 and pins 56 (push direction switching mechanism 54) of the push button 48. The transmission member 44 (coupling part 45) pushes the lock claw 37 downwardly with the coupling part 39 of the lock claw 37. The claw part 38 of the lock claw 37 is drawn into the coupling hole 9, so that the claw part 38 is released from the inner perimeter part of the coupling hole 9. As a result, the lid 4 is opened with the force of the spring 14 acting on the lid 4.

In this case, when the hand (finger) is removed from the push button 48 to stop the lock release operation, the claw part 38 protrudes from inside the main body with the force of the coil spring 43. When the lock claw 37 moves upwardly, the transmission member 44 also moves upwardly through the engagement between the lock claw 37 and the transmission member 44. Accordingly, the rotation type damper 20 is rotated with the rack part 57 on the transmission member 44, thereby applying the damping force to the lock claw 37 and the transmission member 44. Therefore, a time for returning the lock claw 37 to the locked state becomes longer than a normal case (when the damping force is not applied), so that it is possible to assuredly open the lid 4 without engaging the claw part 38 with the coupling claw 9 on the box 3.

In the present embodiment, the lock release operation piece is the push button 48, and the push button 48 is pushed in a direction that the lid 4 is closed. Further, in the closed state of the lid 4, the lid 4 is inclined toward the closed side and a weight of the lid 4 acts toward the closing direction. Accordingly, there is a possibility that the lid 4 is opened slowly with the force of the spring 14, and the claw part 38 may engage again the inner perimeter part of the coupling hole 9 of the box 3. However, as described above, the time of returning the claw part 38 to the original position (locked state) becomes longer with the damping force of the rotation type damper 20. Therefore, it is possible to deal with such a possibility.

In the present embodiment, it is not necessary to reduce the spring force of the coil spring 43 so that the claw part 38 protrudes slowly to prevent the claw part 38 from engaging when the lock is released. Accordingly, it is possible to firmly push the push button 48. Further, it is not necessary to increase the force of the spring 14 so that the lid 4 opens quickly to prevent the claw part 38 from engaging. Accordingly, the spring 14 does not deform under a high-temperature atmosphere. Further, it is not necessary to reduce the torque of the rotation type damper 15 so that the lid 4 open quickly to prevent the claw part 38 from engaging, thereby making it possible to open the lid 4 gently.

Figure 8:
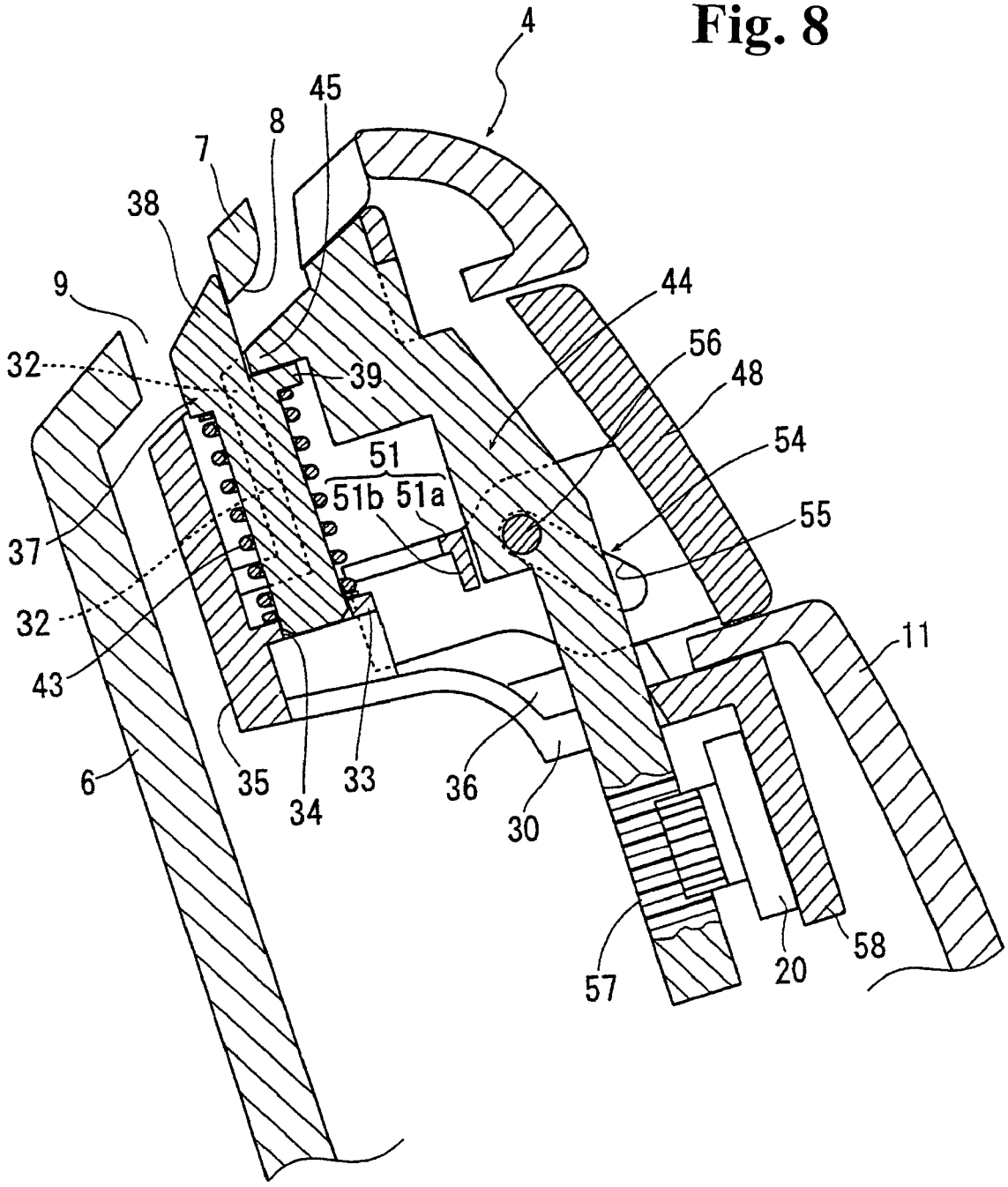
FIG. 8 is an explanatory sectional view for explaining a structure of a lock mechanism (lock unit) according to a second embodiment.
Figure 9:
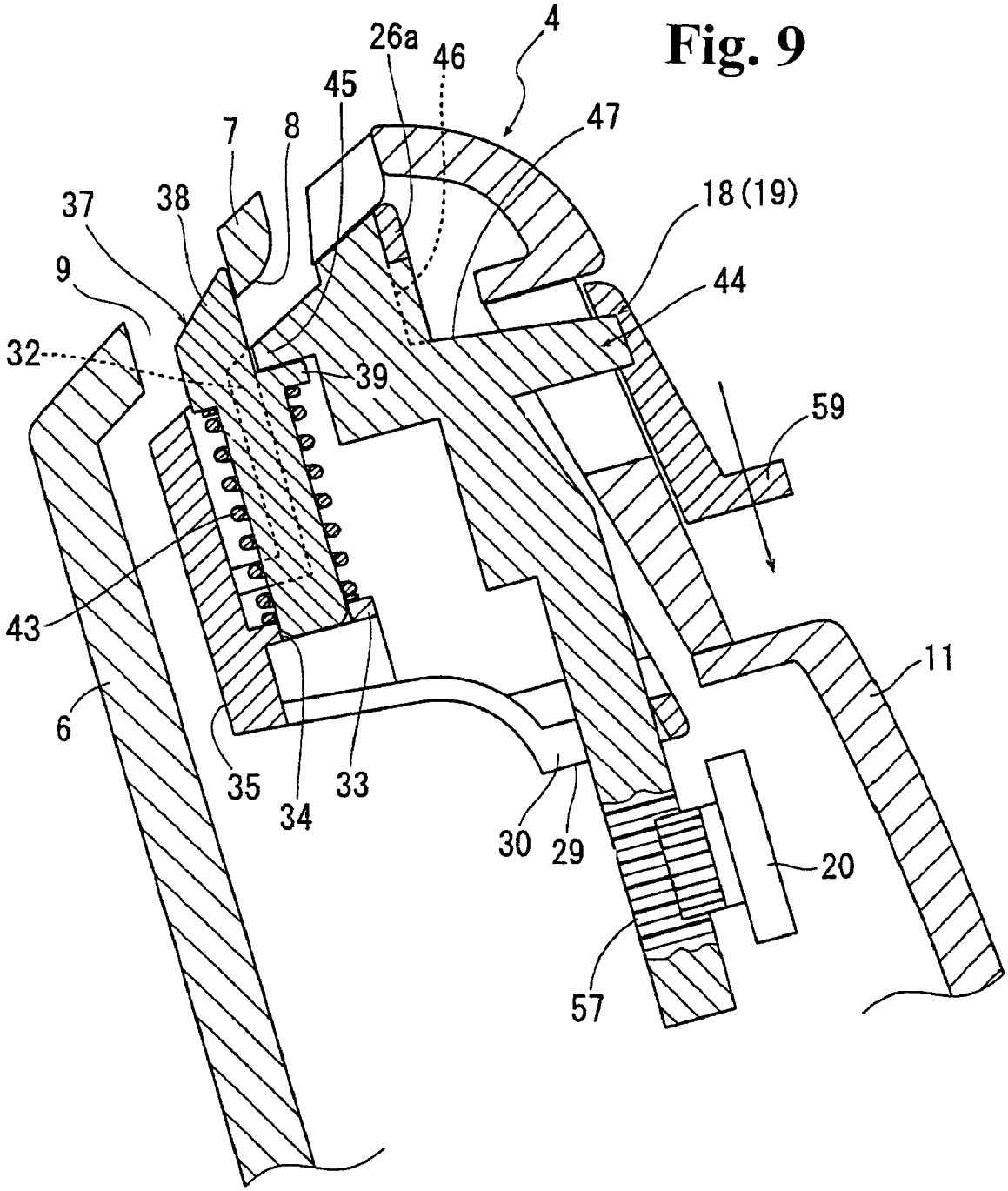
FIG. 9 is an explanatory sectional view for explaining a structure of a lock mechanism (lock unit) according to a third embodiment.

FIG. 8 shows a second embodiment, and FIG. 9 shows a third embodiment. In the embodiments, the same symbols are assigned to the same constituent elements as in the first embodiment, and their explanations are omitted.

In the second embodiment shown in FIG. 8, an attachment part 58 is extended from the main body part 21, and the rotation type damper 20 engaging the rack part 57 is attached to the attachment part 58. Accordingly, it is possible to incorporate all the lock mechanisms into the lock unit 19, so that the lock unit 19 (attachment part 58) is attached to the lid 4 (inner panel 10) to form the lock mechanism 18.

In the third embodiment shown in FIG. 9, an operation lever 59 is provided as the lock release operation piece. The operation lever 59 is integrated directly with the transmission member 44 without interposing a mechanism such as the push button switching mechanism 54. The operation lever 59 is arranged to move the lock claw 37 in the lock releasing direction. That is, when the operation lever 59 moves, a operating force is transmitted to the lock claw 37 through the transmission member 44, so that the claw part 38 of the lock claw 37 is pulled down into the main body part 21. When the operation lever 59 is released, the claw part 38 returns. At this time, the damping force is applied to the movement as in the embodiments described above. Accordingly, it is possible to assuredly prevent the claw part 38 from engaging the coupling hole 9 again, thereby making it possible to assuredly open the lid 4.

The embodiments have been explained above, and may have the following features.

1) In a cup holder with an opening-and-closing door, the lock mechanism may be applied to the opening-and-closing door.
2) As the damping device, any type may be used as far as the damping device can apply resistance (damping) to the displacement movement. The resistance of the damping device may be applied to a member such as a push button 48 moving with the lock claw 37 upon the lock release operation as well as the transmission member 44.
3) When the rack part 57 and the rotation type damper 20 (damping device) are assembled, the rotation type damper 20 may be attached to the transmission member 44, and the rack part 57 may be attached to the lid 4 (inner panel 10) or the main body part 21.

The disclosure of Japanese Patent Application No. 2004-008216, filed on Jan. 15, 2004, is incorporated in the application.

While the invention has been explained with reference to the specific embodiments of the invention, the explanation is illustrative and the invention is limited only by the appended claims.

What is claimed is:

1. A door lock mechanism, comprising:

a lock claw, a spring attached to the lock claw for urging the lock claw in a direction toward a lock state, a lock release operation piece linked to the lock claw for moving the lock claw in a direction toward a lock release state against a force of the spring when a lock release operation is performed, said lock release operation piece returning the lock claw to the lock state with the force of the spring when the lock release operation is canceled, said lock release operation piece being arranged to be separated from the lock claw with respect to an external force applied to the lock claw when the lock claw returns from the lock release state to the lock state, a transmission member formed separately from the lock claw and the lock release operation piece, said transmission member engaging the lock release operation piece and the lock claw and being arranged such that when the lock release operation piece is actuated to move the lock claw in the direction toward the lock release state, the transmission member is linearly moved in a direction same as that of the lock claw by the lock release operation piece to thereby move the lock claw toward the lock release state, and a damping device engaging the transmission member for applying a damping force to the lock claw through the transmission member.

2. A door lock mechanism according to claim 1, wherein said transmission member abuts against the lock claw so that the lock release operation piece applies a force to the lock claw only in a direction toward the lock release state.

3. A door lock mechanism according to claim 2, further comprising a push direction switching mechanism disposed between the lock release operation piece and the transmission member, said lock release operation piece including a push button to be pushed when the lock release operation is performed, said push direction switching mechanism transmitting a pressing force from the push button to the transmission member so that the lock claw moves toward the lock release state.

4. A door lock mechanism according to claim 2, wherein said lock release operation piece includes an operation lever for moving the lock claw toward the lock release state when the lock release operation is performed, said transmission member being integrated with the operation lever.

5. A door lock mechanism, comprising:

a lock claw, a spring attached to the lock claw for urging the lock claw in a direction toward a lock state, a lock release operation piece linked to the lock claw for moving the lock claw in a direction toward a lock release state against a force of the spring when a lock release operation is performed, said lock release operation piece returning the lock claw to the lock state with the force of the spring when the lock release operation is canceled, said lock release operation piece being arranged to be separated from the lock claw with respect to an external force applied to the lock claw when the lock claw returns from the lock release state to the lock state, a transmission member disposed between the lock release operation piece and the lock claw, said transmission member being linked to the lock release operation piece so that the lock claw moves in the direction toward the lock release state when the lock release operation is performed, said transmission member abutting against the lock claw so that the lock release operation piece applies a force to the lock claw only in a direction toward the lock release state, and a damping device for applying a damping force to the transmission member or the lock release operation piece when the lock release operation is canceled, wherein said damping device includes a rack and a rotation damper engaging the rack for generating the damping force while rotating, one of said rack and said rotation damper being provided on one of the transmission member and the lock release operation piece, the other of said rack and said rotation damper engaging the one of the rack and the rotation damper and being incapable of moving when the one of the transmission member and the lock release operation piece moves.

6. A door lock mechanism according to claim 1, further comprising an opening-and-closing door of a compartment in an automobile, to which said door lock mechanism is attached.

7. A door lock mechanism according to claim 6, wherein said opening-and-closing door is arranged in an inclined state so that a weight of the opening-and-closing door is applied in a closing direction when the opening-and-closing door is closed.

8. A door lock unit comprising the door lock mechanism according to claim 1, and a main body having an attachment part for attaching a door, said lock claw being disposed in the main body to be capable of appearing and disappearing, and said lock release operation piece being arranged in the main body to link to the lock claw for drawing the lock claw into the main body in the lock release operation and allowing the lock claw to protrude from the main body in releasing the lock release operation.

9. A door lock unit according to claim 8, wherein said transmission member abuts against the lock claw so that the lock release operation piece applies a force to the lock claw only in a direction toward the lock release state.

10. A door lock unit according to claim 9, further comprising a push direction switching mechanism disposed in the main body between the lock release operation piece and the transmission member, said lock release operation piece including a push button to be pushed when the lock release operation is performed, said push direction switching mechanism transmitting a pressing force on the push button to the transmission member so that the lock claw moves toward the lock release state.

11. A door lock unit according to claim 9, wherein said damping device includes a rack and a rotation damper engaging the rack for generating the damping force while rotating, one of said rack and said rotation damper being provided on one of the transmission member and the lock release operation piece.

12. A door lock unit according to claim 9, wherein said damping device includes a rack and a rotation damper engaging the rack for generating the damping force while rotating, one of said rack and said rotation damper being provided on one of the transmission member and the lock release operation piece, the other of said rack and said rotation damper engaging the one of the rack and the rotation damper and being incapable of moving when the one of the transmission member and the lock release operation piece moves.

13. A door lock mechanism according to claim 1, wherein said damping device includes a rack formed at the transmission member, and a rotation damper engaging the rack.

14. A door lock mechanism according to claim 13, wherein said lock release operation piece is a push button having an inclined long hole, and the transmission member includes a pin engaging the long hole so that when the push button is pushed, the transmission member is moved downwardly.

* * * * *